US008591145B1

(12) United States Patent
Engel et al.

(10) Patent No.: US 8,591,145 B1
(45) Date of Patent: Nov. 26, 2013

(54) EXTENSION MOUNTING SYSTEM AND METHOD FOR ATTACHING SCREED EXTENSION TO SCREED

(75) Inventors: Brett Wayne Engel, Brooklyn, MN (US); Karl E. Lindenmuth, Wamego, KS (US); Andy L. Vering, Manhattan, KS (US); Jameson Michael Smieja, Brooklyn Park, MN (US)

(73) Assignee: Caterpillar Paving Products Inc., Minneapolis, MN (US)

( * ) Notice: Subject to any disclaimer, the term of this patent is extended or adjusted under 35 U.S.C. 154(b) by 0 days.

(21) Appl. No.: 13/465,336

(22) Filed: May 7, 2012

(51) Int. Cl.
*E01C 19/22* (2006.01)

(52) U.S. Cl.
USPC ..... 404/104; 404/118

(58) Field of Classification Search
USPC ..... 404/104, 118
See application file for complete search history.

(56) References Cited

U.S. PATENT DOCUMENTS 3,702,578 A 11/1972 Davin
4,379,653 A 4/1983 Brown
5,203,642 A 4/1993 Heller et al.
7,287,931 B2 10/2007 Anibaldi et al.
7,651,295 B2 1/2010 Eppes et al.
8,221,025 B2 * 7/2012 Buschmann et al. ..... 404/75
8,221,026 B2 * 7/2012 Munz et al. ..... 404/96
D672,790 S * 12/2012 Kopacz et al. ..... D15/19
D673,981 S * 1/2013 Kopacz et al. ..... D15/19

* cited by examiner

*Primary Examiner* — Gary Hartmann
(74) *Attorney, Agent, or Firm* — Liell & McNeil

(57) ABSTRACT

A screed has an extendible frame portion that includes a catch engaging surface of an extension mounting system. The extendible frame portion is expandable along a lateral extension axis and pivotable about a pivot axis perpendicular to the lateral extension axis. A screed extension has a screed extension frame supporting a mounting catch of the extension mounting system. In a mounting configuration, the extendible frame portion is pivoted to a lowered mounting position, and the extendible frame portion is axially expanded to an extended mounting position in which the catch engaging surface and the mounting catch are vertically aligned. In a lifted configuration, the extendible frame portion is pivoted to a raised lifting position, the catch engaging surface and the mounting catch are in mating engagement, and the screed extension is supported on the extendible frame portion using the extension mounting system.

17 Claims, 4 Drawing Sheets

EXTENSION MOUNTING SYSTEM AND METHOD FOR ATTACHING SCREED EXTENSION TO SCREED

TECHNICAL FIELD

The present disclosure relates generally to an extension mounting system for attaching a screed extension to a screed, and more particularly to an extension mounting system including a catch engaging surface pivotable with an extendible frame portion of the screed and shaped to engage a mounting catch of the screed extension.

BACKGROUND

A paving machine, such as an asphalt paver, is generally a self-propelled machine designed to receive, convey, distribute, and partially compact paving material, such as asphalt. Typically, the paving machine receives the paving material in a hopper positioned at the front of the machine, conveys the paving material from the hopper to the rear of the machine with parallel slat conveyors, distributes the paving material along a desired width, and compacts the paving material into a mat with a screed. The width of the screed, which may be adjustable, typically defines the paving width provided by the particular paving machine. In particular, some paving machines include frame portions that are hydraulically extendible in the lateral direction to increase the paving width. Mechanical extensions, such as bolt-on extensions, may also be utilized for increasing the paving width provided by the based screed.

Mechanical extensions can be relatively heavy and typically require an additional piece of equipment, such as a forklift or crane, for lifting the mechanical extension into alignment with the base screed. Once the mechanical extension and base screed are aligned, the bolted connections are secured to maintain proper positioning of the mechanical extension. Often, these bolted connections are numerous and difficult to access. Thus, attaching a mechanical extension to a base screed, particularly when conducted in the field, can be difficult, time-consuming, costly, and may require equipment that is not readily available.

U.S. Pat. No. 3,702,578 to Davin teaches a quick change screed extension for paving machines. In particular, Davin teaches an adapter plate for a side wall of a main screed having a plurality of socket lugs. The extension includes upwardly extending pins received in the socket lugs when the screed extension is raised relative to the main screed, such as by using a lift handle. When the pins are appropriately positioned through the socket lugs, wedges may be positioned through slots of the pins to maintain the position of the extension. Although the Davin reference may teach a suitable extension installation system, the Davin installation means appears to be applicable to relatively lightweight extensions that may be lifted by hand using the lift handle.

The present disclosure is directed to one or more of the problems or issues set forth above.

SUMMARY OF THE DISCLOSURE

In one aspect, a screed has a lateral extension axis and includes an extendible frame portion having a catch engaging surface of an extension mounting system. The extendible frame portion is expandable along the lateral extension axis and pivotable relative to a pivot axis perpendicular to the lateral extension axis. A screed extension has a screed extension frame supporting a mounting catch of the extension mounting system. In a mounting configuration, the extendible frame portion is pivoted about the pivot axis in a first direction to a lowered mounting position, and the extendible frame portion is axially expanded to an extended mounting position in which the catch engaging surface and the mounting catch are vertically aligned. In a lifted configuration, the extendible frame portion is pivoted about the pivot axis in a second direction to a raised lifting position, the catch engaging surface and the mounting catch are in mating engagement, and the screed extension is supported on the extendible frame portion using the extension mounting system.

In another aspect, a method for attaching a screed extension to a screed includes pivoting an extendible frame portion of the screed about a pivot axis in a first direction to a lowered mounting position to position a catch engaging surface of the extendible frame portion below a mounting catch of the screed extension. The extendible frame portion is axially expanded to an extended mounting position to vertically align the catch engaging surface and the mounting catch. The extendible frame portion is then pivoted about the pivot axis in a second direction to a raised lifting position to bring the catch engaging surface and the mounting catch into mating engagement and support the screed extension on the extendible frame portion.

In yet another aspect, a screed extension for a screed having an extendible frame portion includes a screed extension frame supporting a mounting catch of an extension mounting system. The mounting catch is supported from a vertical mounting wall of the screed extension frame and includes an inner surface shaped for mating engagement with a catch engaging surface of the extendible frame portion in a raised lifting position of the extendible frame portion. The screed extension also includes a set of wall openings through the vertical mounting wall positioned for alignment with a corresponding set of wall openings through the extendible frame portion in the raised lifting position. The wall openings through the vertical mounting wall are shaped to receive a set of locking devices of an extension locking system.

DETAILED DESCRIPTION

Figure 1:
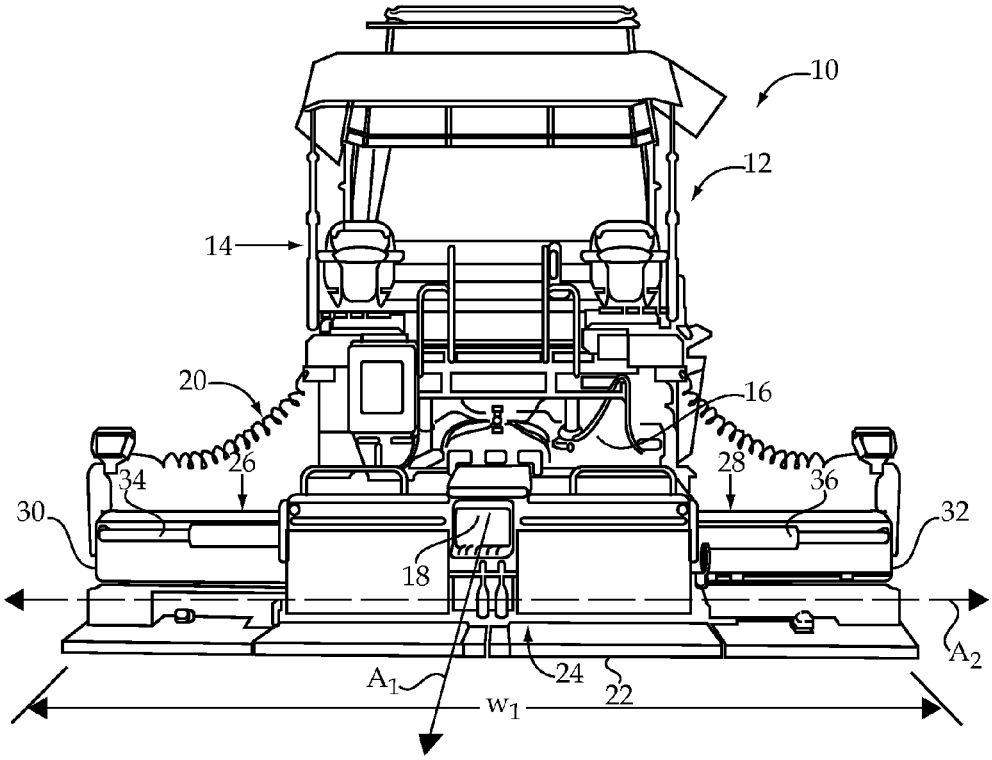
FIG. 1 is a rear diagrammatic view of a paving machine having a screed with an extendible frame portion, according to the present disclosure.

An exemplary embodiment of a paving machine 10 is shown generally in FIG. 1. The paving machine 10, which may also be referred to as an asphalt paver, may be any machine used to distribute a layer of paving material P on the surface S of a roadway or other area as the paving machine 10 is moved in a paving direction along paving axis $A_1$. The paving machine 10 generally includes a tractor portion 12 including a power source, such as an internal combustion engine, ground-engaging propulsion elements, some or all of which may be powered by the power source, and an operator control station 14. The power source, ground-engaging propulsion elements, and operator control station 14 may all be supported on a machine frame 16 of the machine 10. The machine frame 16 may also support various other components and systems, including a hopper supported on a front portion of the machine frame 16 for receiving the paving material P.

A conveyor may also be supported on the machine frame 16 and may convey the paving material P received within the hopper to a screed 18, such as a free floating screed, coupled with the paving machine 10, such as via tow arms, at a rear portion 20 of the machine frame 16. The screed 18 may distribute and, at least partially, compact the paving material P into a mat on the desired paving surface S. In particular, a screed plate 22 at the bottom portion of the screed 18 may flatten and compress the paving material P. The tractor portion 12 of the paving machine 10 may also include hydraulic drives and controls, along with various other known paving machine components, for operating various systems and components of the paving machine 10. The screed portion 18 of the paving machine 10 may also include additional components and systems, such as, for example, leveling arms, vibrators, sensors, and controllers, as are known to those skilled in the art. Such additional systems and components are not within the scope of the present disclosure and, thus, will not be discussed herein in greater detail.

The screed 18 may generally include a main frame portion 24, a first extendible frame portion 26, and a second extendible frame portion 28. Each extendible frame portion 26 and 28 may be mounted on the main frame portion 24 and may be expandable along an extension axis $A_2$, also referred to as a lateral extension axis, of the screed 18. For example, the extendible frame portions 26 and 28 may be axially expandable along the extension axis $A_2$ to an extended position defining a first paving width $w_1$. In particular end walls 30 and 32, which are axially movable away from the main frame portion 24, may roughly define an adjustable paving width. The extendible frame portions 26 and 28 may also be axially shortened along the extension axis $A_2$, such as by moving the end walls 30 and 32 toward the main frame portion 24, to a shortened position defining a second paving width $w_2$, shown in FIG. 2, which may be shorter than the first paving width $w_1$. According to the exemplary embodiment, the paving width provided by the screed 18 may be adjustable to any width between and including the first paving width $w_1$ and the second paving width $w_2$.

According to a specific example, the first and second extendible frame portions 26 and 28 may be hydraulically extendible, or expandable, using respective extension cylinders 34 and 36, as is known by those skilled in the art. In particular, the extendible frame portions 26 and 28 may be expanded or shortened to effectively extend or shorten the adjustable paving width. According to some embodiments, each extendible frame portion 26 and 28 may be independently adjustable. Since the screed assembly 18 is substantially symmetrical with respect to a longitudinal centerline of the paving machine 10, only the first extendible frame portion 26 will be referenced throughout the remaining disclosure. However, it should be appreciated that the extendible frame portion 28 may have similar components and capabilities.

Figure 2:
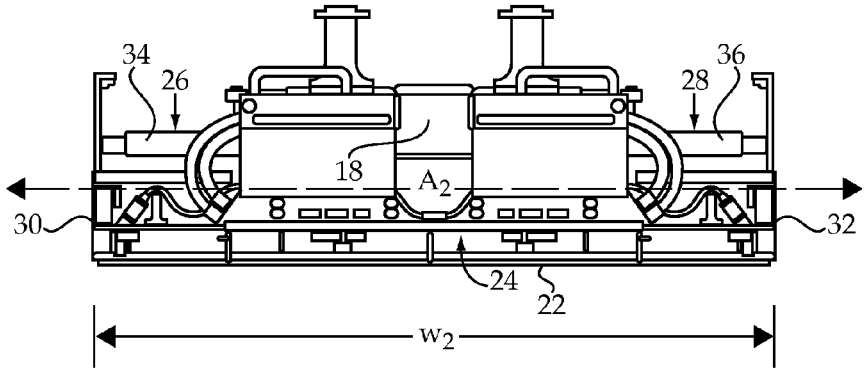
FIG. 2 is a rear diagrammatic view of the screed of the paving machine of FIG. 1, with the extendible frame portion shown in a shortened position, according to an aspect of the present disclosure.
Figure 3:
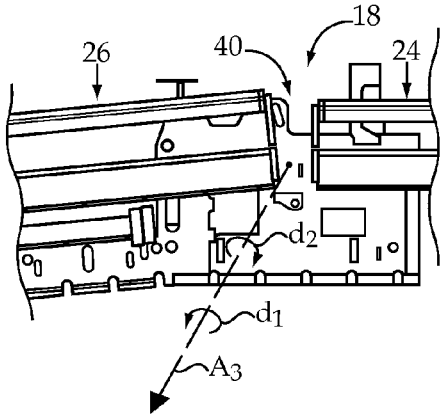
FIG. 3 is a diagrammatic view depicting a portion of the extendible frame portion pivoted to a lowered position, according to another aspect of the present disclosure.

Turning now to FIG. 3, the extendible frame portion 26 may be connected to the main frame portion 24 at a pivotable joint 40 and, thus, may be pivotable relative to a pivot axis $A_3$ parallel to the paving axis $A_1$. For example, the extendible frame portion 26 may be pivoted in a first direction $d_1$ about the pivot axis $A_3$ to move the extendible frame portion 26 to a lowered position, as shown. The extendible frame portion 26 may also be pivoted in a second direction $d_2$ about the pivot axis $A_3$, which is opposite the first direction $d_1$, to return the extendible frame portion 26 to a raised position, as shown in FIGS. 1 and 2. It should be appreciated that the extendible frame portions 26 and 28 may be pivotable to adjust a paving slope provided along paving widths corresponding to the extendible frame portions 26 and 28. Such pivoting capabilities are known, and one exemplary pivotable joint is taught in U.S. Pat. No. 5,203,642 to Heller et al.

Figure 4:
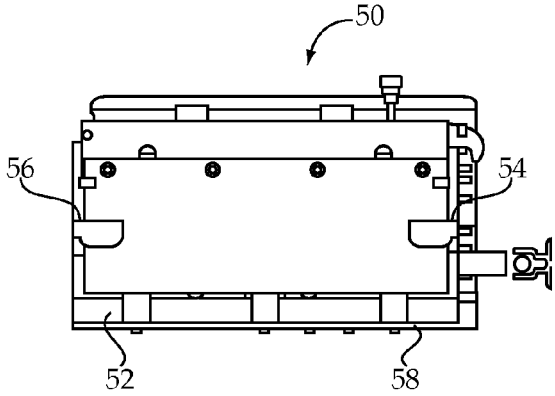
FIG. 4 is a diagrammatic view of a screed extension, according to another aspect of the present disclosure.

A screed extension 50, also referred to as a rigid or mechanical extension, is shown generally in FIG. 4. Although a rigid extension is shown, it should be appreciated that the screed extension 50 may alternatively include an extendible screed extension, such as a hydraulically extendible extension. The screed extension 50 may include a screed extension frame 52 having at least two spaced apart and substantially parallel vertical end walls 54 and 56 and supporting a screed plate 58. The screed extension 50 may include and support additional components, similar to those of the screed 18, and may be provided to extend the paving width of the screed 18 along the extension axis $A_2$. Specifically, the paving width $p_1$ may be further extended by adding a screed extension, such as extension 50, to one or both of the extendible frame portions 26 and 28 to define a screed assembly, as described below.

Figure 5:
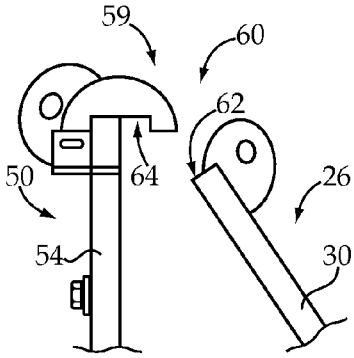
FIG. 5 is a partially sectioned side view of a first stage of a method for attaching the screed extension to the extendible frame portion using a first embodiment of an extension mounting system, with the extendible frame portion shown in a lowered mounting position, according to a mounting configuration described with respect to another aspect of the present disclosure.

Turning now to FIG. 5, an extension mounting system 60 may be used for mounting or attaching the screed extension 50 to the screed 18 to define the screed assembly 59. The extension mounting system 60 may generally include a catch engaging surface 62 of the extendible frame portion 26 and a mounting catch 64 supported on the screed extension frame 52 or, more specifically, the screed extension end wall 54. Specific embodiments of the components defining the extension mounting system 60 will be described below with reference to FIGS. 7-11.

Returning to FIG. 5, a method for attaching the screed extension 50 to the extendible frame portion 26 using the extension mounting system 60 will be described. To facilitate attachment, the extendible frame portion 26 may be moved into a mounting configuration. At a first stage, the extendible frame portion 26 may be pivoted about the pivot axis $A_3$ in the first direction $d_1$ to a lowered mounting position, which may be similar to the lowered position of FIG. 3. In particular, and as will become more clear below, the catch engaging surface 62 may be positioned below the mounting catch 64.

Figure 6:
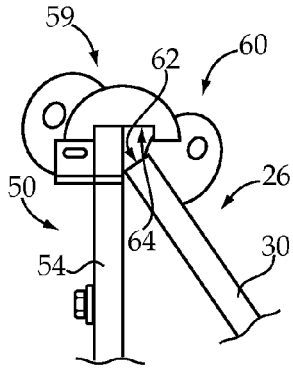
FIG. 6 is a partially sectioned side view of a second stage of the method referred to in FIG. 5, with the extendible frame portion shown in an extended mounting position, according to the mounting configuration described with respect to another aspect of the present disclosure.

At a second stage, the mounting may be facilitated by axially expanding the extendible frame portion 26 to an extended mounting position, as shown in FIG. 6. In particular, the extendible frame portion 26 may be axially expanded, such as by moving end wall 30 away from the main frame portion 24 and toward the screed extension 50, to vertically align the catch engaging surface 62 and the mounting catch 64. To take full advantage of the movement capabilities of the extendible frame portion 26 during the mounting procedure, it may be desirable to begin the transition to the mounting configuration with the extendible frame portion 26 at least partially shortened, with the end wall 30 retracted at least partially toward the main frame portion 26. It should be appreciated that movement of the main frame portion 24 of the screed 18 and movement of the tractor portion 12 of the paving machine 10 may also be used to achieve the positioning shown in FIGS. 5 and 6.

Figure 7:
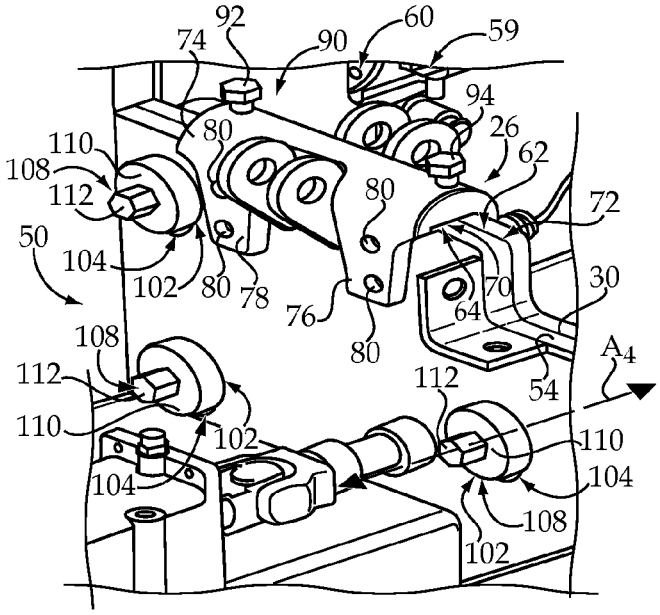
FIG. 7 is a first side perspective view of a third stage of the method of FIGS. 5 and 6, with the extendible frame portion shown in a raised lifting position, according to a lifted configuration described with respect to another aspect of the present disclosure.

After the catch engaging surface 62 and mounting catch 64 are moved into vertical alignment, the extendible frame portion 26 may be pivoted about the pivot axis $A_3$ in the second direction $d_2$ to a raised lifting position, as shown in FIG. 7. In particular, FIG. 7 depicts a lifted configuration of a first exemplary embodiment of the extension mounting system 60. According to the lifted configuration, the catch engaging surface 62 and the mounting catch 64 are in mating engagement, and the screed extension 50 is supported on the extendible frame portion 26 using the extension mounting system 60. "Mating engagement," as used herein, generally means that corresponding or complementary components are contacted or joined to facilitate attachment.

According to the first exemplary embodiment, the mounting catch 64 may include an elongate channel 70 shaped to receive an upper end wall surface 72, which defines the catch engaging surface 62. The elongate channel 70 may be defined by an attachment 74 fastened to the end wall 54 of the screed extension 50. As shown, attachment flanges 76 and 78 may be bolted or otherwise secured to the end wall 54, such as via a bolted connection 80. As shown, the attachment 74 may extend a majority of the length of the screed extension end wall 54 and may define a channel 70 sized to receive the screed extension end wall 54 and the extendible frame portion end wall 30. Although a bolt-on attachment is shown, it should be appreciated that the attachment 74 and channel 70 may be integral with the screed extension frame 52.

An extension orientation adjustment system 90 may be provided for adjusting an orientation of the screed extension 50 relative to an orientation of the extendible frame portion 26 once the screed extension 50 is supported on the extendible frame portion 26. The extension orientation adjustment system 90 may include a pair of spaced apart vertical adjustment devices 92 and 94, such as push bolts, coupled with the attachment 74. As shown, each of the adjustment devices 92 and 94 may be positioned through the attachment 74 at the elongate channel 70 and may be independently movable to engage the upper end wall surface 72. According to a specific example, each of the adjustment devices 92 and 94 may be threadably received or withdrawn through the attachment 74 to engage the upper end wall surface 72 and raise or lower the screed extension 50 relative to the extendible frame portion 26. As stated, the adjustment devices 92 and 94 may be independently adjustable to effectively adjust the orientation of the screed extension 50 relative to the orientation of the extendible frame portion 26. For example, orientation may be adjusted to properly align the screed plate 58 of the screed extension 50 with the screed plate 22 of the screed portion 18.

Figure 8:
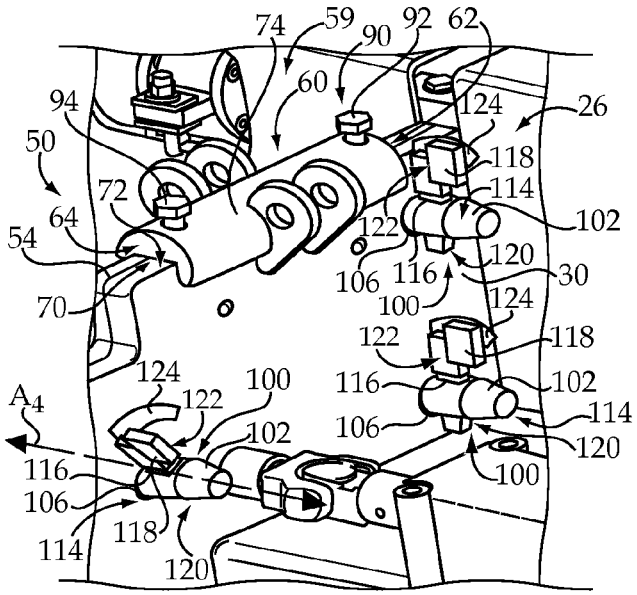
FIG. 8 is a second side perspective view of the third stage of the method referred to in FIG. 7, according to the lifted configuration described with respect to another aspect of the present disclosure.

Referring to both FIGS. 7 and 8, an extension locking system 100 may also be provided for securing the orientation of the screed extension 50 relative to the orientation of the extendible frame portion 26. In particular, the proper orientation achieved using the extension orientation adjustment system 90 may be locked using the extension locking system 100. According to the first exemplary embodiment, the extension locking system 100 may generally include a set of locking devices 102, such as locking pins, positioned through wall openings 104 of the screed extension 50 and wall openings 106 of the extendible frame portion 26. First ends 108 of the locking devices 102 may support flanges or washers 110 and hex-shaped ends 112. According to alternative embodiments, however, the flanges 110 may be hex-shaped.

Referring specifically to FIG. 8, second ends 114 of the locking devices 102 may include slots 116 for receiving locking wedges 118. Each locking wedge 118 may be tapered such that first ends 120 are narrower than second ends 122 and are also narrower than slots 116 to facilitate insertion of the locking wedges 118 into the slots 116. As should be appreciated, the locking wedges 118 may be inserted into slots 116 until the width of the wedges 118 substantially matches the width of the respective slots 116, and the wedges 118 are held into place through frictional engagement. To maintain these locked positions of the wedges 118, flanges, such as arc-shaped flanges 124, may be provided on the end wall 30. The flanges 124 are positioned adjacent each of the wall openings 106 and shaped to drivingly engage the ends 122 of the locking wedges 118 as the locking wedges 118 are rotated. In particular, each locking wedge 118 may have an orientation that is substantially transverse to a longitudinal axis $A_4$ of each locking device 102. Once the wedge 118 is positioned through the slot 116, the locking wedge 118 may be pivoted about the axis $A_4$, such as by rotating the locking device 102 using the hex-shaped end 112 or applying force to the wedge end 122 using hammer blows. As the locking device 102 and locking wedge 118 are rotated, the flanges may be shaped to drive the locking wedge 118 further through the slot 116 and maintain the locked position.

Figure 9:
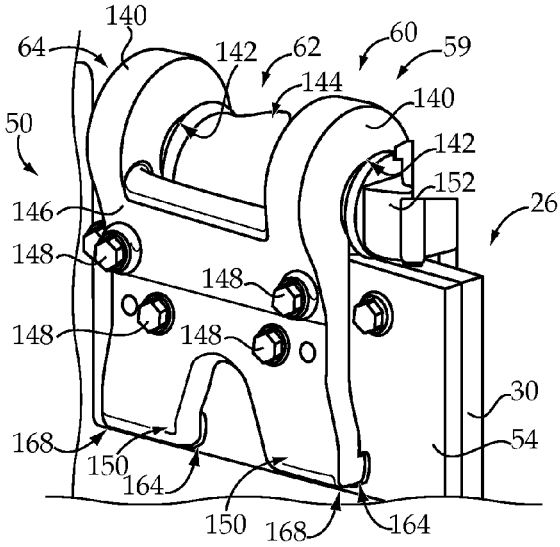
FIG. 9 is a first side perspective view of a third stage of a method for attaching the screed extension to the extendible frame portion using a second embodiment of the extension mounting system, with the extendible frame portion shown in a raised lifting position, according to the lifted configuration described with respect to another aspect of the present disclosure.
Figure 10:
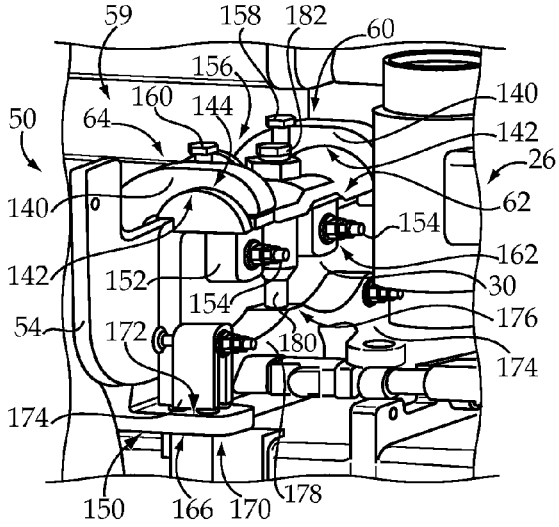
FIG. 10 is a second side perspective view of the third stage of the method referred to in FIG. 9, according to the lifted configuration described with respect to another aspect of the present disclosure.

With reference to FIGS. 9 and 10, and according to a second exemplary embodiment, the mounting catch 64 may include a pair of spaced apart hooks 140 having inner surfaces 142 shaped to receive a curved support surface 144 defining the catch engaging surface 62. The hooks 140 may extend from an attachment 146 fastened to the end wall 54 of the screed extension 50. As shown, portions of the attachment 146 may be bolted or otherwise secured to the end wall 54, such as via a bolted connection 148. According to the exemplary embodiment, in addition to supporting the spaced apart hooks 140, the attachment 146 may also support locking devices 150, which will be discussed in greater detail below. As such, the spaced apart hooks 140 and the locking devices 150 may form an integral component, namely attachment 146. The catch mounting surface 62 of the second exemplary embodiment may include an extendible frame attachment 152 defining the curved support surface 144. As shown in FIG. 10, the portions of the attachment 152 may be bolted or otherwise secured to the end wall 30, such as via a bolted connection 154.

An extension orientation adjustment system 156, which may be similar to the extension orientation adjustment system 90 discussed above, may be provided for adjusting an orientation of the screed extension 50 relative to an orientation of the extendible frame portion 26. In particular, the extension orientation adjustment system 156 may include a pair of spaced apart vertical adjustment devices 158 and 160, such as push bolts, coupled with the extendible frame attachment 152. As shown, each of the adjustment devices 158 and 160 may be positioned through the attachment 152 or, more specifically, the curved support surface 144, and may be independently movable to raise or lower one of the extendible frame portion 26 and the screed extension 50 relative to the other. As stated above, the adjustment devices 158 and 160 may be independently adjustable to effectively adjust the orientation of the screed extension 50 relative to the orientation of the extendible frame portion 26.

Figure 11:
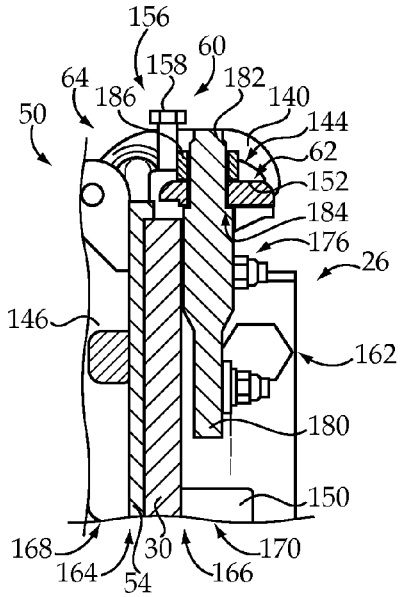
FIG. 11 is a sectional view taken along lines 11-11 of FIG. 10, according to another aspect of the present disclosure.

Referring generally to FIGS. 9, 10, and 11, an extension locking system 162 may also be provided for securing the orientation of the screed extension 50 relative to the orientation of the extendible frame portion 26. According to the first exemplary embodiment, the extension locking system 162 may generally include the locking devices 150 positioned through wall openings 164 of the screed extension 50 and wall openings 166 of the extendible frame portion 26. As stated above, first ends 168 of the locking devices 150 may be integral with attachment 152. Second ends 170 of the locking devices 150 may include slots 172 for receiving locking wedges 174. Each locking wedge 174 may be tapered to facilitate insertion of the locking wedges 174 into the slots 172. As should be appreciated, the locking wedges 174 may be inserted into slots 172 until the width of the wedges 174 substantially matches the width of the respective slots 172 and the wedges 174 are held into place through frictional engagement.

To maintain these locked positions of the locking wedges 174, the extension locking system 162 may also include a wedge actuation device 176 for selecting and maintaining a desired holding force acting upon an integral structure 178 supporting the locking wedges 174. As best shown in FIG. 11, the wedge actuation device 176 may include a screw 180 that has a threaded engagement with the integral structure 178 such that rotation of the screw 180 may drive the wedges 174 further through the slots 172. For example, the screw 180 may be rotated using a hex-shaped end 182. According to a specific embodiment, when the screw 180 is rotated in a first direction to maintain a stronger force on the integral structure 178 and, thus, wedges 174, a load is placed on a shoulder 184 of the screw 180. When the screw 180 is rotated in the opposite direction, the force on the wedges 174 is decreased, and the load is placed on a jam nut 186.

Heat treating the integral structure 178 supporting the locking wedges 174 may create a spring force that will keep the joint tight even with a small amount of setting. This may remove the need for spring washers. However, it should be appreciated that a number of alternative devices may replace the wedge actuation device 176. For example, any locking device that is capable of extending and retracting the wedges 174 may be used. Some other options may incorporate springs to maintain a clamp force without tightening the locking device to account for movement and wearing of the wedges 174 during operation, or may use a hydraulic cylinder with constant pressure to maintain the clamp force.

INDUSTRIAL APPLICABILITY

The present disclosure finds potential application in any paving machine that utilizes screed extensions to increase paving width. Further, the disclosure may be applicable to mechanical or rigid screed extensions for paving screeds that have extendible and pivotable frame portions. Further, the disclosure may be specifically applicable to mounting systems and methods for attaching the screed extension to an extendible and pivotable frame portion of a screed to define a screed assembly.

Referring generally to FIGS. 1-11, an exemplary paving machine 10 may include a tractor portion 12, which may generally include a power source, ground-engaging propulsion elements, and an operator control station 14 supported on a machine frame 16. A hopper may be supported on a front portion of the machine frame 16 for receiving a paving material P, such as from a dump truck traveling in front of the paving machine 10. A conveyor may also be supported on the machine frame 16 and may convey the paving material P received within the hopper to a screed 18 coupled with the paving machine 10 at a rear portion 20 of the machine frame 16. The screed 18 may be used to distribute and, at least partially, compact the paving material P into a mat on a desired paving surface S.

The screed 18 generally includes a main frame portion 24 and at least one extendible frame portion 26. The extendible frame portion 26 may be axially expandable and retractable along a lateral extension axis $A_2$, and may be pivotable relative to a pivot axis $A_3$ perpendicular to the lateral extension axis $A_2$. The paving width provided by the screed 18 and the one or more extendible portions, such as extendible frame portion 26, may be further extended by attaching a screed extension 50 to the extendible frame portion 26 to define a screed assembly 59. Although not discussed in detail, it should be appreciated that an additional screed extension may be attached at the opposing end of the screed 18 to the extendible frame portion 28. Further, it should be appreciated that one or more additional screed extensions, similar to extension 50, may be supported on screed extension 50.

In particular, and according to the extension mounting system 60 and method provided herein, the extendible frame portion 26 may be pivoted about the pivot axis $A_3$ in a first direction $d_1$ to a lowered mounting position to position the catch engaging surface 62 below the mounting catch 64, as shown in FIGS. 3 and 5. The extendible frame portion 26 may be axially expanded to an extended mounting position, as shown in FIG. 6, to vertically align the catch engaging surface 62 and the mounting catch 64. The extendible frame portion 26 may then be pivoted about the pivot axis $A_3$ in a second direction $d_2$ to a raised lifting position to bring the catch engaging surface 62 and the mounting catch 64 into mating engagement, as shown in FIGS. 7-11. As a result, the screed extension 50 is supported on the extendible frame portion 26 using the extension mounting system 60.

After the screed extension 50 has been lifted and mounted using the extension mounting system 60, an extension orientation adjustment system, such as systems 90 and 156, may be used to adjust the orientation of the screed extension 50 relative to the orientation of the extendible frame portion 26. Once the orientation is acceptable, an extension locking system, such as systems 100 and 162, may be used to secure the position and orientation of the screed extension 50 relative to the orientation of the extendible frame portion 26. It should be appreciated that numerous modifications may be made to the specific embodiments provided herein without deviating from the scope of the disclosure.

The extension mounting system and method provided herein provides a relatively quick and effective means for attaching a screed extension to an extendible and pivotable frame portion of a screed. The disclosed system and method utilizes the extendible and pivotable frame portion to lift and initially position the screed extension, while additional systems orient and lock the desired position and orientation. Thus, the system and method does not require the use of additional equipment, such as forklifts or cranes, to lift and mount the screed extension, and does not include numerous and difficult to access connections for securing the position of the screed extension to the screed.

It should be understood that the above description is intended for illustrative purposes only, and is not intended to limit the scope of the present disclosure in any way. Thus, those skilled in the art will appreciate that other aspects of the disclosure can be obtained from a study of the drawings, the disclosure and the appended claims.

What is claimed is:

1. A screed assembly, comprising:

a screed having a lateral extension axis and including an extendible frame portion expandable along the lateral extension axis and pivotable relative to a pivot axis perpendicular to the lateral extension axis, wherein the extendible frame portion includes a catch engaging surface of an extension mounting system; and a screed extension having a screed extension frame supporting a mounting catch of the extension mounting system;

wherein, in a mounting configuration, the extendible frame portion is pivoted about the pivot axis in a first direction to a lowered mounting position, and the extendible frame portion is axially expanded to an extended mounting position in which the catch engaging surface and the mounting catch are vertically aligned;

wherein, in a lifted configuration, the extendible frame portion is pivoted about the pivot axis in a second direction to a raised lifting position, the catch engaging surface and the mounting catch are in mating engagement, and the screed extension is supported on the extendible frame portion using the extension mounting system.

2. The screed assembly of claim 1, further including:

an extension orientation adjustment system for adjusting an orientation of the screed extension relative to an orientation of the extendible frame portion; and an extension locking system for securing the orientation of the screed extension relative to the orientation of the extendible frame portion.

3. The screed assembly of claim 2, wherein the catch engaging surface includes an upper end wall surface of the extendible frame portion, and the mounting catch includes an elongate channel shaped to receive the upper end wall surface.

4. The screed assembly of claim 3, wherein the extension orientation adjustment system includes a pair of spaced apart vertical adjustment devices coupled with the elongate channel, wherein each of the pair of spaced apart vertical adjustment devices is independently movable to raise or lower the screed extension relative to the extendible frame portion.

5. The screed assembly of claim 4, wherein the extension locking system includes:

a locking device positioned through a wall opening of the screed extension and a wall opening of the extendible frame portion, wherein the locking devices has a longitudinal axis; and a locking wedge positioned through a slot formed in the locking device and having a substantially transverse orientation relative to the longitudinal axis.

6. The screed assembly of claim 5, wherein the extension locking system further includes a flange positioned adjacent the wall opening of the extendible frame portion and shaped to drivingly engage an end of the locking wedge as the locking wedge is pivoted about the longitudinal axis.

7. The screed assembly of claim 2, wherein the catch engaging surface includes an extendible frame attachment defining a curved support surface, and the mounting catch includes a pair of spaced apart hooks having inner surfaces shaped to receive the curved support surface.

8. The screed assembly of claim 7, wherein the extension orientation adjustment system includes a pair of spaced apart vertical adjustment devices coupled with the extendible frame attachment, wherein each of the pair of spaced apart vertical adjustment devices is independently movable to raise or lower the screed extension relative to the extendible frame portion.

9. The screed assembly of claim 8, wherein the extension locking system includes:

a locking device positioned through a wall opening of the screed extension and a wall opening of the extendible frame portion; and a locking wedge positioned through a slot formed in the locking device.

10. The screed assembly of claim 9, wherein the pair of spaced apart hooks and the locking device form an integral component.

11. The screed assembly of claim 10, wherein the extension locking system further includes a wedge actuation device for selecting and maintaining a desired holding force acting upon the locking wedge.

12. A method for attaching a screed extension to a screed of a screed assembly, the screed having a lateral extension axis and including an extendible frame portion expandable along the lateral extension axis and pivotable relative to a pivot axis perpendicular to the lateral extension axis, wherein the extendible frame portion includes a catch engaging surface of an extension mounting system, the screed extension having a screed extension frame supporting a mounting catch of the extension mounting system, the method comprising steps of:

pivoting the extendible frame portion about the pivot axis in a first direction to a lowered mounting position to position the catch engaging surface below the mounting catch;

axially expanding the extendible frame portion to an extended mounting position to vertically align the catch engaging surface and the mounting catch; and pivoting the extendible frame portion about the pivot axis in a second direction to a raised lifting position to bring the catch engaging surface and the mounting catch into mating engagement and support the screed extension on the extendible frame portion using the extension mounting system.

13. The method of claim 12, further including:

adjusting an orientation of the screed extension relative to an orientation of the extendible frame portion using an extension orientation adjustment system; and securing the orientation of the screed extension relative to the orientation of the extendible frame portion using an extension locking system.

14. The method of claim 13, wherein pivoting the extendible frame portion to the raised lifting position includes receiving an upper end wall surface of the extendible frame portion within an elongate channel of the screed extension.

15. The method of claim 13, wherein pivoting the extendible frame portion to the raised lifting position includes engaging a curved support surface of an extendible frame attachment of the extendible frame portion with inner surfaces of a pair of spaced apart hooks of the screed extension.

16. The method of claim 13, wherein adjusting the orientation of the screed extension relative to the orientation of the extendible frame portion includes independently moving a pair of spaced apart vertical adjustment devices coupled with one of the screed extension and the extendible frame portion to raise or lower the screed extension relative to the extendible frame portion.

17. The method of claim 16, wherein securing the orientation of the screed extension relative to the orientation of the extendible frame portion includes:

positioning a locking device through a wall opening of the screed extension and a wall opening of the extendible frame portion; and positioning a locking wedge through a slot formed in the locking device.

* * * * *